US005956828A

United States Patent [19]

Chiou et al.

[11] Patent Number: 5,956,828

[45] Date of Patent: Sep. 28, 1999

[54] SANDING APPARATUS FOR AIR TEXTURED YARN AND FALSE TWIST YARN

[75] Inventors: Hsin-Hsiung Chiou, Taipei; Sheng-Fu Chiu, Tainan Hsien; Tsung-Kun Hsu, Taoyean; Victor Sun; Pao-Chi Chen, both of Taipei Hsien, all of Taiwan

[73] Assignee: China Textile Institute, Taipe Hsien, Taiwan

[21] Appl. No.: 09/085,831

[22] Filed: May 28, 1998

[51] Int. Cl.[6] ..... D02J 3/02

[52] U.S. Cl. ..... 28/219; 28/247; 28/243

[58] Field of Search ..... 28/219, 243, 259, 28/247, 252; 26/28

[56] References Cited

U.S. PATENT DOCUMENTS

| | | | |
|---|---|---|---|
| 3,140,526 | 7/1964 | Tlamicha | 28/219 |
| 3,229,347 | 1/1966 | Tlamicha | 28/219 |
| 3,499,195 | 3/1970 | Wethington | 28/219 |
| 3,831,360 | 8/1974 | Horvath | 28/219 |
| 4,674,271 | 6/1987 | Bird | 28/219 |
| 4,944,751 | 7/1990 | Yamada | 28/219 |

*Primary Examiner*—Amy B. Vanatta
*Attorney, Agent, or Firm*—Rosenberg, Klein & Bilker

[57] ABSTRACT

The present invention relates to a sanding apparatus used for the production of air textured yarn and false twist yarn. The apparatus comprises a motor, a housing provided with a guide groove, and a frictional disk connected to the motor and enclosed in the housing. The apparatus can be arranged in an intermediate section of the production process to generate short hair on the outer surface of yarn by the contact between the frictional disk and moving yarn. Accordingly the products made by the apparatus have soft tactile feelings when touched.

3 Claims, 6 Drawing Sheets

SANDING APPARATUS FOR AIR TEXTURED YARN AND FALSE TWIST YARN

SUMMARY OF THE INVENTION

For a long time fashion trend and people's demands for clothes have been continuously changing. Clothes that can give wearers a soft tender tactile feeling have become people's favorite garments. To get such an effect, these clothes generally are made of yarn having short hair.

The prior art of producing this kind of yarn primarily uses a winding or knitting method to attach short lints to main yarn. Cloth made of such yarn can have the desired effect. However, such a manufacturing process is costly and lengthy. Besides, short lints adhered to yarn by such a method easily come off so that clothes made of such yarn are easily worn out.

In view of the above problems, the primary object of the invention is to provide a sanding apparatus for air textured yarn and false twist yarn, which makes use of a frictional disk to raise fibers by tapping the abrasive surface of the disk on yarn, giving yarn a soft tactile feeling. Now the structure and features of the invention will be described below in detail with reference to the accompanying drawings.

DETAILED DESCRIPTION OF PREFERRED EMBODIMENTS

Figure 1:
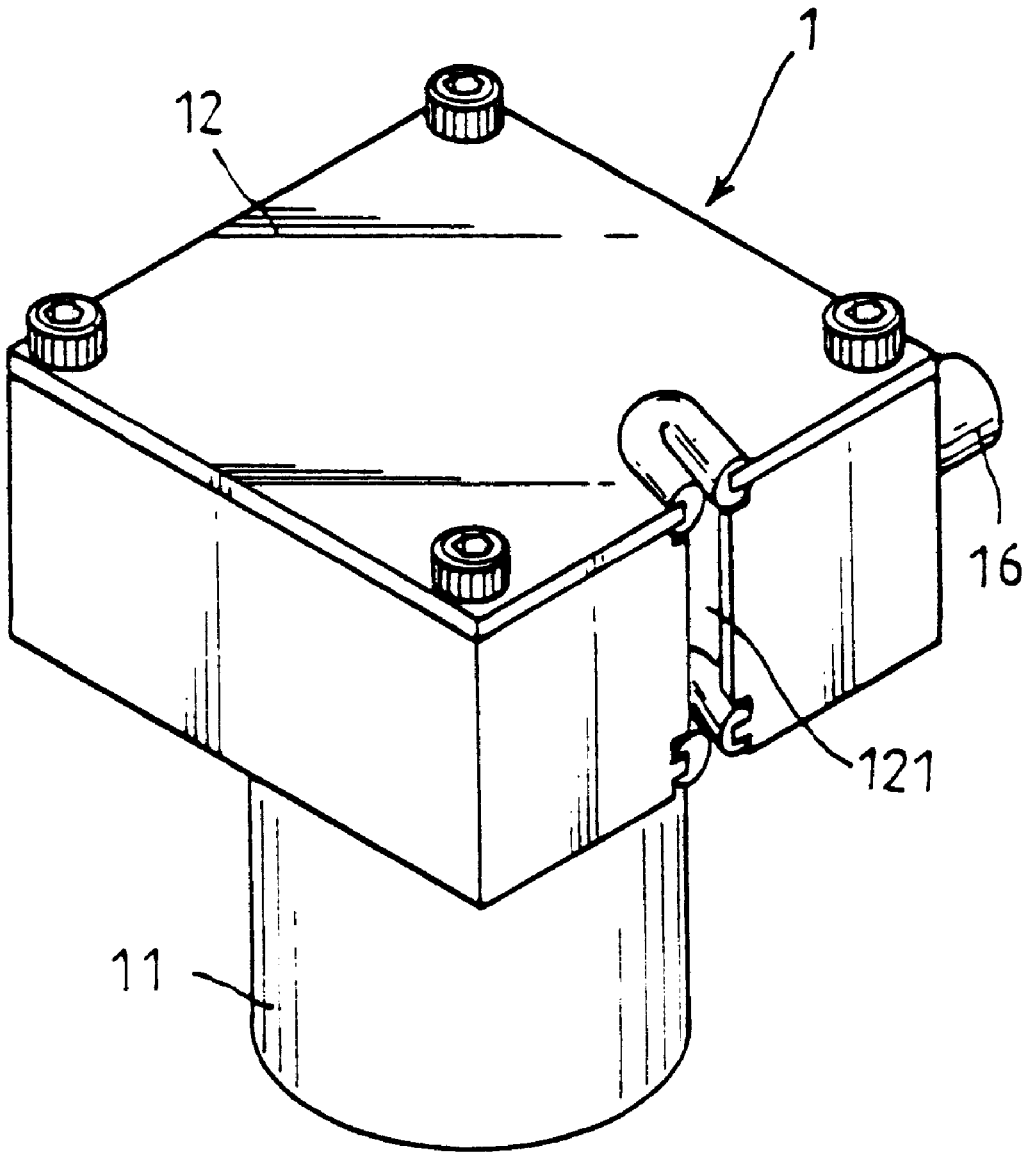
FIG. 1 is a perspective view of a sanding apparatus according to the invention.
Figure 2:
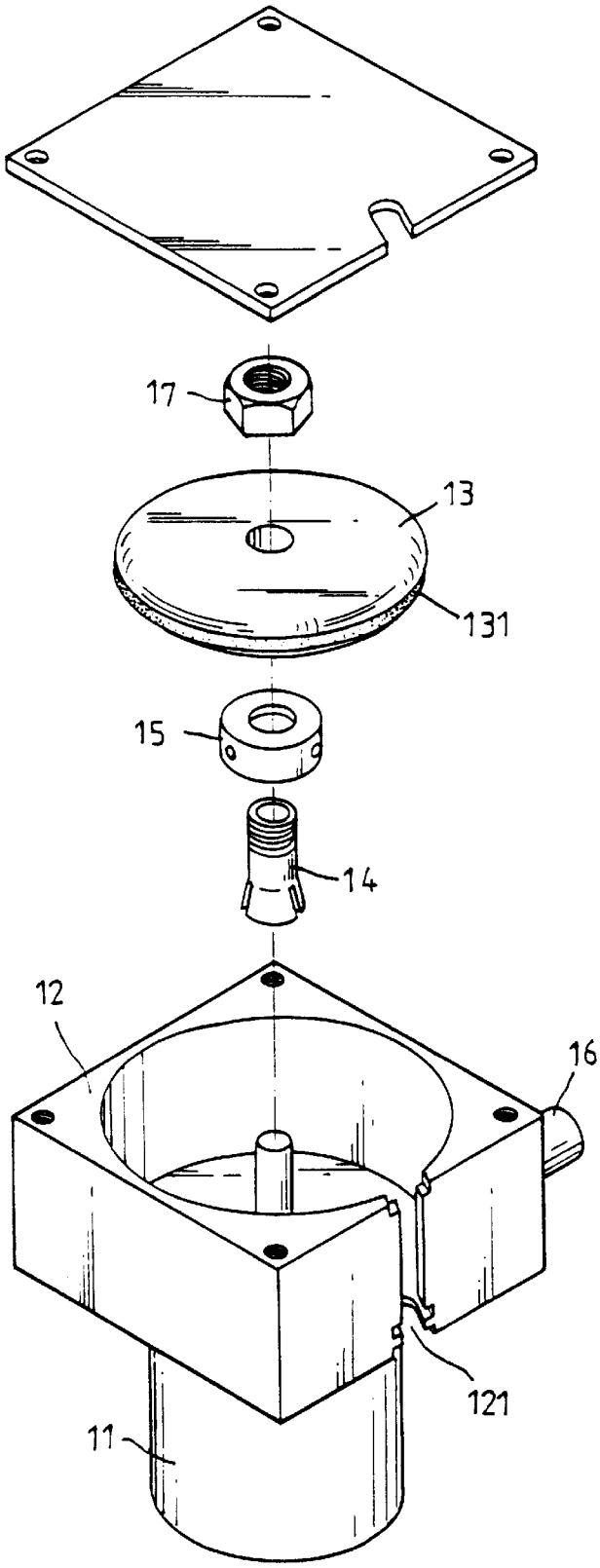
FIG. 2 is an exploded view of the sanding apparatus of FIG. 1.
Figure 4:
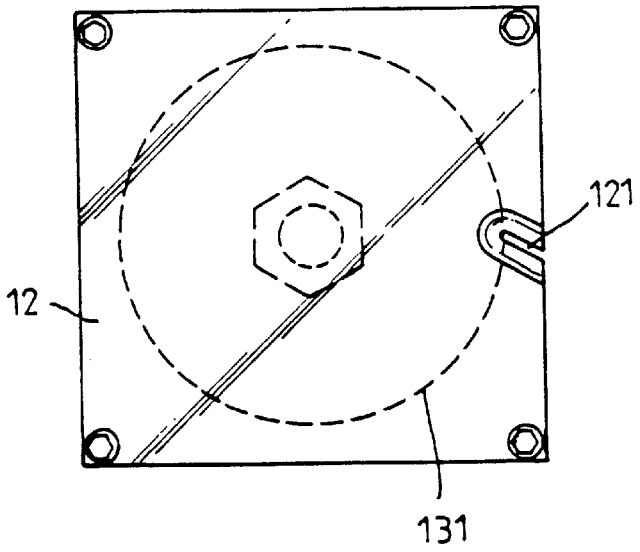
FIG. 4 is a top view of the sanding apparatus.
Figure 3:
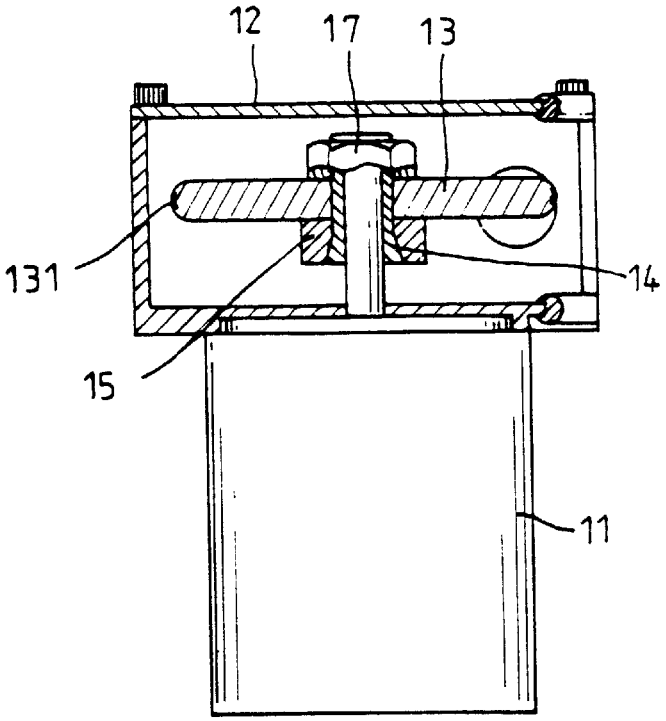
FIG. 3 is a cross sectional view of the sanding apparatus shown in FIG. 1.

Referring to FIGS. 1 through 4, the sanding apparatus (1) according to the present invention includes a motor (11), a housing (12), and a frictional disk (13). A sleeve (14) fits over the shaft of the motor (11) and is locked thereon by a collar (15) with bolts. A frictional disk (13) is secured to the top of the sleeve (14) by a nut so that the motor (11) can drive the disk (13) to rotate. The disk (13) has an annular abrasive surface (131) disposed at its outermost border. The housing (12) enclosing the frictional disk (13) is provided on one side thereof with a guide groove (121) and on the other side with a tube (16) that is in communication with a suction device.

Figure 5:
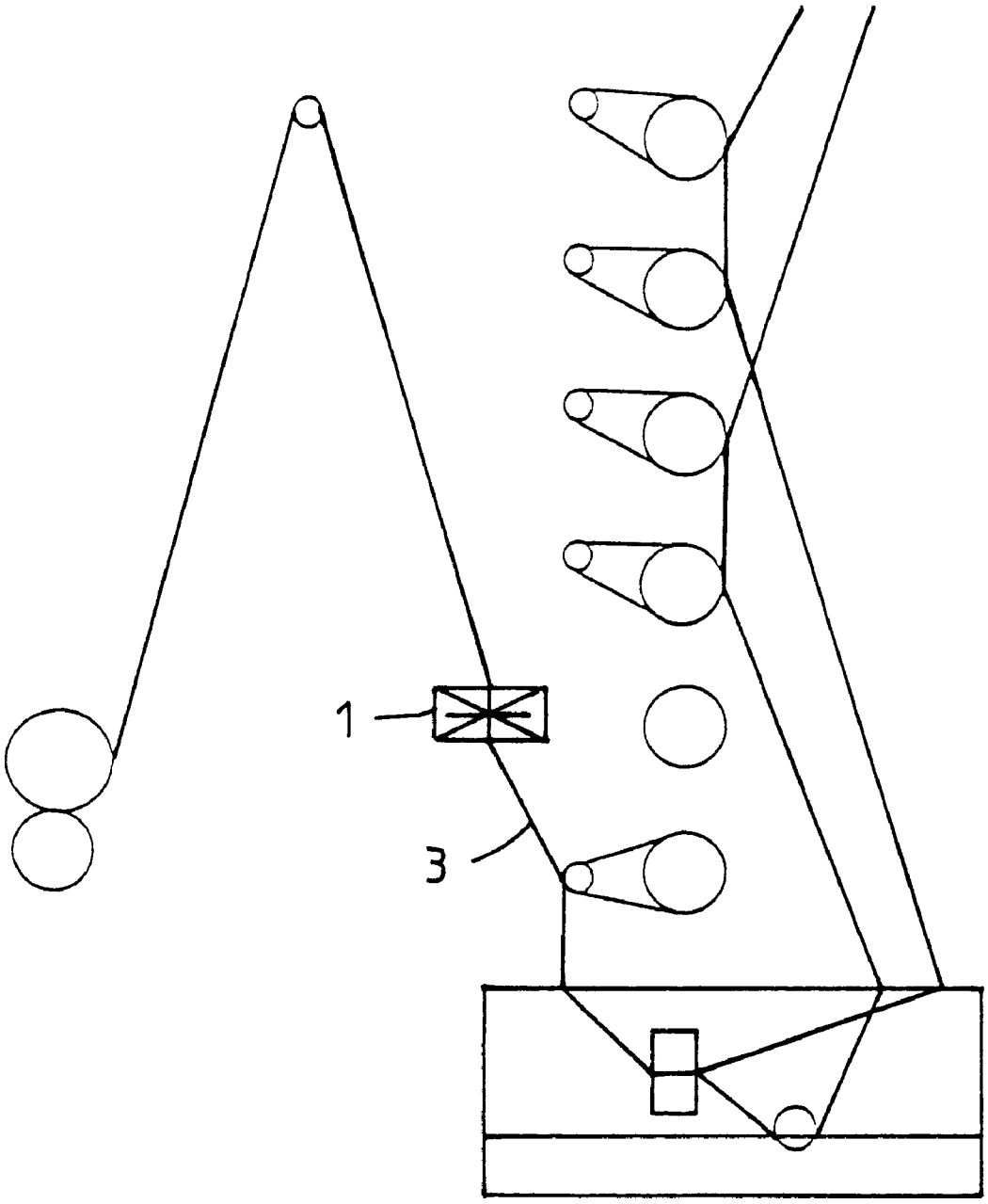
FIG. 5 illustrates the exemplary application of the sanding apparatus of the invention.
Figure 6:
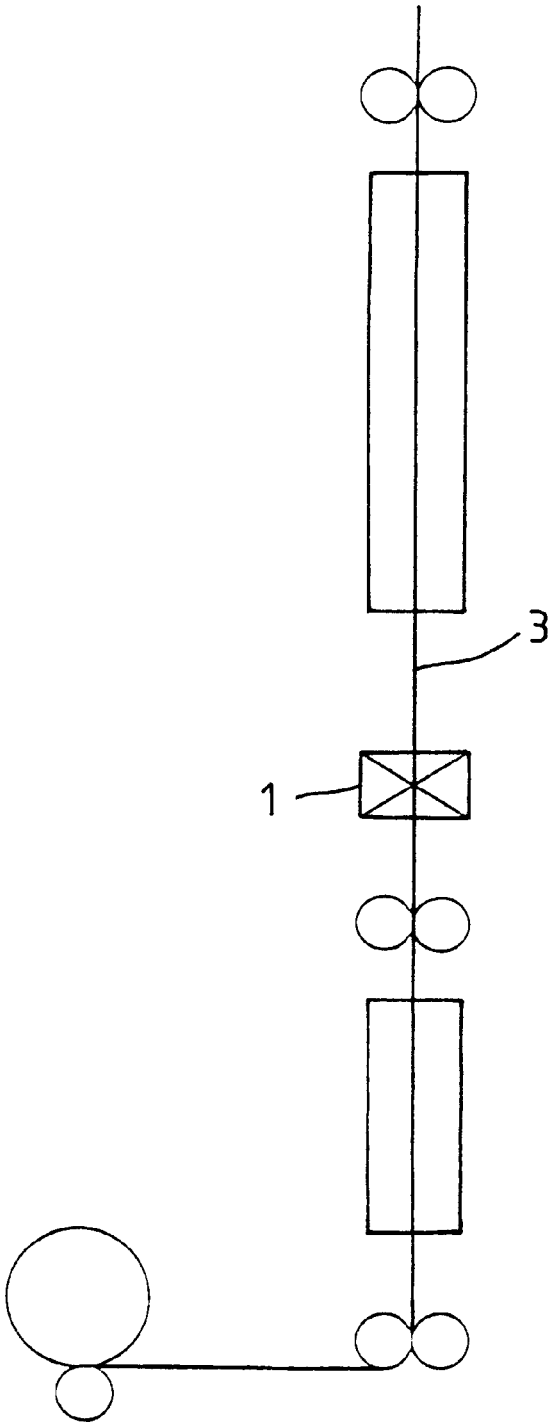
FIG. 6 depicts another exemplary application of the sanding apparatus of the invention.

In operation, the apparatus of the invention can be disposed in the intermediate section of a yarn manufacturing process. FIG. 5 shows an exemplary application of the apparatus in an air textured yarn manufacturing process. FIG. 6 shows another application in the production of false twist yarn and compound yarn. During processing, the yarn (3) is driven into the guide groove (121) of the housing (12) where the yarn gets in touch with the abrasive surface (131) of the frictional disk (13). When the motor (11) moves the frictional disk (13), quickly moving yarn (3) passes over the abrasive surface (131) so that the fiber on the outer layer of yarn (3) lifts, resulting in a soft tactile feeling when the yarn is touched by hands. Besides, the dropped wool fibers can be removed by a suction device via a connection tube (16).

To attain different levels of sanding, the apparatus of the invention can be adjusted by means of the tangential velocity and the acceleration and deceleration of the frictional disk as well as the roughness of the abrasive surface of the disk. Thus the apparatus can make yarn reach different softness degrees. For instance, the roughness range of the abrasive surface can be from 30 P to 2000 P, and the tangential velocity of the disk can be between 100 to 3000 meters per minute, and the acceleration and deceleration in the tangential direction range from 0 to 200 m per square second. They are the preferred range of the invention.

Figure 7:
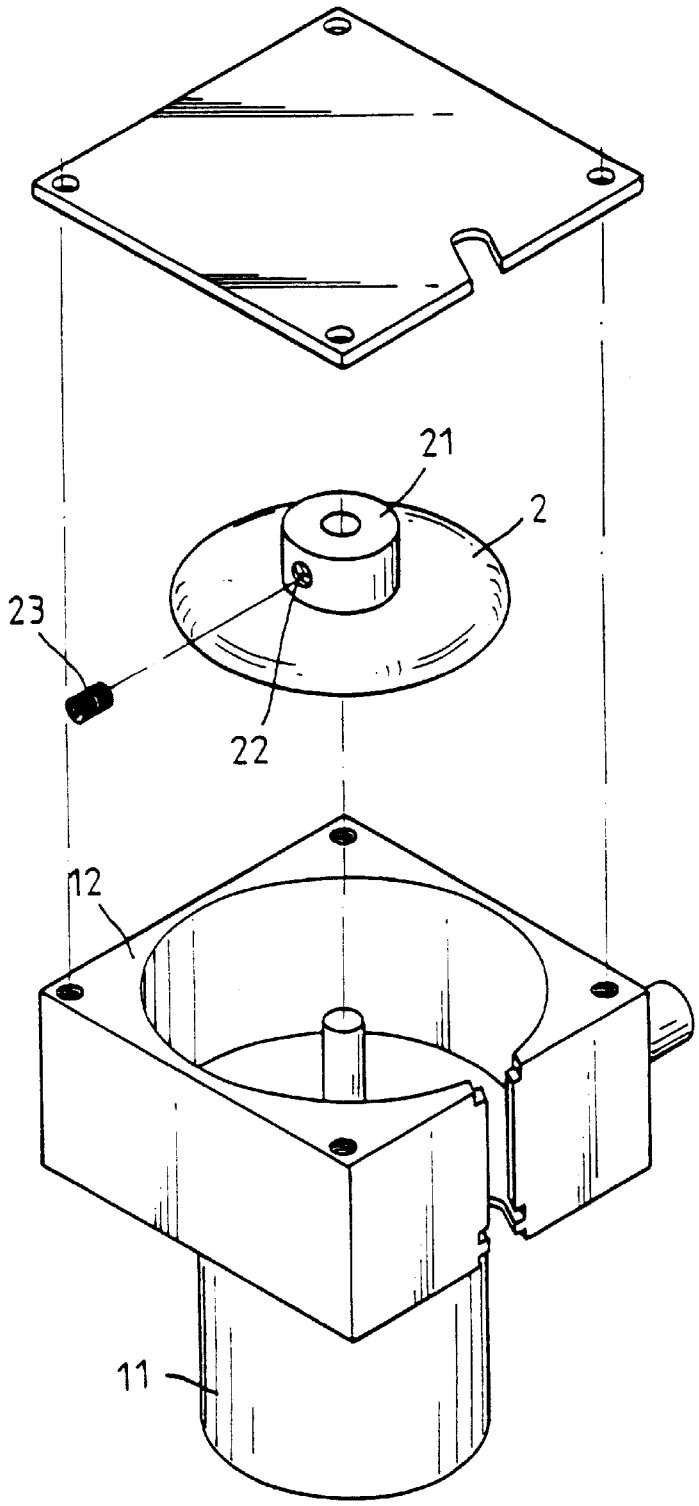
FIG. 7 illustrates the another construction of the frictional disk according to the invention.

As shown in FIG. 7, the invention can adopt another configuration in which a frictional disk (2) is fastened to the shaft of the motor (11) via a bushing (21) located on the center of the disk. The bushing (21) is secured by bolts (23) passing through the screw holes (22) of the bushing and thus the frictional disk (2) directly mounts over the motor shaft. The outer surface of the disk (2) is designed to be abrasive for sanding. Therefore, the disk can be driven by the motor to sand yarn (3).

As described above, the inventive apparatus can be incorporated into the production of yarn in an on-line manner. It can add values to yarn products, eliminate adhesive effect, and can be selectively used in the production of yarn spinning. Thus it can increase the variations of yarn products. Evidently the invention has the following advantages:

1. It can be selectively applied to production and can be incorporated into the production of air textured yarn and false twist yarn in an on-line manner to reduce sanding processing.
2. It is adaptable for assorted of air textured yarn and false twist yarn processing equipment and increases product variations. Thus the capital investment in production equipment can be lowered.
3. It can promote the quality of yarn products by adjusting sanding to acquire optimal tactile feelings.

What is claimed is:

1. A sanding apparatus adaptable for selective on-line use in air textured yarn and false twist yarn production, comprising a motor having a shaft, a sleeve fitting over the shaft of the motor and being locked thereon by a collar with bolts, a frictional disk secured to a top portion of the sleeve by a nut and having an abrasive cylindrical surface on an outermost rim of the frictional disk, a housing enclosing the frictional disk and provided on one side thereof with a guide groove and a tube that is in fluid communication with a suction device on another side; wherein moving yarn is led into the guide groove where the yarn contacts the abrasive surface of the frictional disk so that when the motor drives the disk, the abrasive surface will raise the fiber on an outer surface of the yarn, producing lint-like short hair.

2. The sanding apparatus as claimed in claim 1, in which the abrasive surface of the frictional disk has a roughness ranging from 30 P to 2000 P, the tangential velocity of the disk is between 100 to 3000 meters per minute and the acceleration and the deceleration of the disk in tangential directions ranges from 0 to 200 meters per square second.

3. A sanding apparatus adaptable for selective on-line use in air textured yarn and false twist yarn production, comprising:

a motor having a shaft;

a frictional disk with an abrasive rim surface and a central bushing, the frictional disk being connected to the motor by locking the central bushing over the shaft of the motor by bolts so that the motor can drive the frictional disk; and, a housing enclosing the frictional disk and provided with a guide groove on one side thereof and a tube in fluid communication with a suction device on another side, wherein moving yarn is led into the guide groove where the yarn contacts the abrasive surface of the frictional disk so that when the motor drives the disk, the abrasive surface will raise the fiber on an outer surface of the yarn, producing lint-like short hair.

* * * * *